United States Patent [19]

Talbot

[11] 4,274,819

[45] Jun. 23, 1981

[54] APPARATUS FOR MAKING SHOT

[76] Inventor: Wilfred A. R. Talbot, 28, Middle La., Cherhill, Calne, Wiltshire, England

[21] Appl. No.: 78,848

[22] Filed: Sep. 25, 1979

[30] Foreign Application Priority Data

Jun. 2, 1977 [GB] United Kingdom ..... 23508/77

[51] Int. Cl.[3] ..... B22D 11/01

[52] U.S. Cl. ..... 425/6

[58] Field of Search ..... 425/6

[56] References Cited

U.S. PATENT DOCUMENTS

| | | | |
|---|---|---|---|
| 1,951,790 | 3/1934 | Curran | 425/6 |
| 2,510,574 | 6/1950 | Greenhalgh | 425/6 |
| 3,869,232 | 3/1975 | Ruus et al. | 425/6 |
| 4,043,716 | 8/1977 | Lafferty et al. | 425/6 |

*Primary Examiner*—Donald E. Czaja
*Assistant Examiner*—James R. Hall
*Attorney, Agent, or Firm*—Finnegan, Henderson, Farabow, Garrett & Dunner

[57] ABSTRACT

An apparatus for making shot is disclosed, in which a container (3) for molten metal is provided with holes (17) which allow molten metal to pass onto a chute (10), there being a torch or torch holder (11) so disposed that in use heat can be directed directly onto metal within the container. Metal shot can be produced efficiently by the apparatus, and the size of the shot can be varied by regulating the temperature.

6 Claims, 4 Drawing Figures

APPARATUS FOR MAKING SHOT

This invention relates to an apparatus for making shot, sometimes hereinafter referred to as a shot maker.

A known shot maker comprises a copper tube angled at 45°, the interior of the tube being blocked by a plate which is provided with a series of jets. In use, solid metal is introduced into the tube at the upper end, and a blow lamp is directed at the underside of the tube, which causes the metal to melt and to pass through the jets in the plate in the form of metal droplets which run the rest of the way down the tube, finally dropping into a container filled with a liquid, normally water, to cause solidification and hence the production of the shot. The main disadvantages with this known shot maker are that it is slow and that control of the size of the shot is difficult; it requires changing the jet.

According to the present invention there is provided an apparatus for making shot, which comprises:

a container for holding the metal used to make shot, the container being provided in a side region with holes through which molten metal may pass;

a chute leading down and away from a lower region of the container, the chute and the container being relatively positioned such that, in use, molten metal passing through the holes in the container falls onto the chute; and a member selected from the group consisting of heating means, and a holder for a heating means, the member being disposed such that, in use, heat can be directed directly onto metal within the container and can optionally be directed onto the container or the upper surface of the chute.

Preferably the heating means and/or the holder therefor is angled such that, in use, the heating means partially heats directly the metal in the container and partially heats that side region of the container provided with holes, so that the chute is also heated by heat conducted from that side region and/or heat deflected by that side region.

The shot maker is intended, in use, to be fitted over a vessel, for example, a five liter tin, which contains a mixture of water and household detergent with a 1.25 cm layer of oil on the surface. The oil may be either hydraulic oil or spent engine oil. The purpose of the oil is to prevent the explosive effect of molten metal balls meeting water. The purpose of the detergent in the water is to remove any oil that may adhere to the balls.

Preferably the lower end of the chute is not more than 1.25 cm above the surface of the liquid in the vessel and not less than 0.625 cm. The container can measure, for example, 7.5 cm×7.5 cm×6.25 cm (height).

Preferably the holes in the side region of the container have a diameter of 0.04 cm and are located between 0.3 cm and 0.1 cm above the chute; if the holes were any higher, cratered shot might be formed.

The chute is preferably angled at 20° and preferably has a length between 2.2 and 2.5 cm, more preferably 2.35 cm. If the plate is too long, the metal of the shot can be burnt.

The tube through which the metal is fed into the containeris preferably made from 24 mm steel tubing and similarly the torch holder is conveniently made from 24 mm steel tubing. Other components can be formed from 22 gauge black mild steel.

For a better understanding of the present invention and to show how the same may be carried into effect, reference will now be made, by way of example, to the accompanying drawing, in which.

Figure 1:
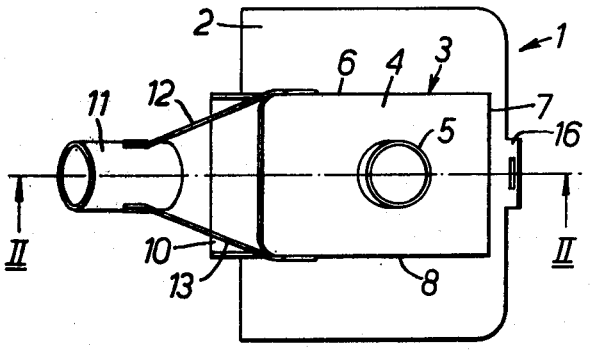
FIG. 1 is a view from above of one embodiment of a shot maker according to the present invention.

In FIG. 1 there is shown a shot maker 1 which comprises a plate 2 made from mild steel upon which is mounted a container generally indicated by the reference numberal 3, for metal. The container 3 is provided with top plate 4 in which is located a tube 5 through which feed metal can be introduced into the container 3. The container 3 has a generally rectangular horizontal cross-section and is defined by four side walls 6,7,8 and 9. Three of the walls 6,7 and 8 extended upwardly to the top plate 4, but the fourth wall 9 is shorter so that there is a space between the top of the wall 9 and the top plate 4. The plate 4 and walls 6,7,8 and 9 are all constructed from mild steel. Adjacent the wall 9 is a shot chute 10 which leads down and away from the wall 9. Also provided is an inclined torch holder 11 held in place by support members 12,13,14 and 15 (member 14 being visible in FIG. 2 and member 15 being visible in FIG. 3) and located on that side of the container 3 which is provided with the wall 9, such that a torch 23 located in the torch holder 11 can be directed towards the space between the wall 9 and the top plate 4. Also provided on that edge of the plate 2 near wall 7 is a fitting lug 16.

Figure 2:
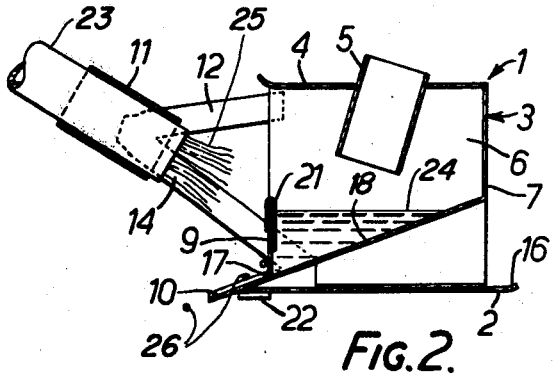
FIG. 2 is a vertical section of the shot maker along the line II—II in FIG. 1.

In FIG. 2 is shown the tube 5 in the top plate 4. Also shown is the side wall 9 which is provided with three 0.04 cm diameter holes 17 and an angled base plate 18 being inclined at 20° C. to the horizontal. Support members 12 and 14 are also visible.

Figure 3:
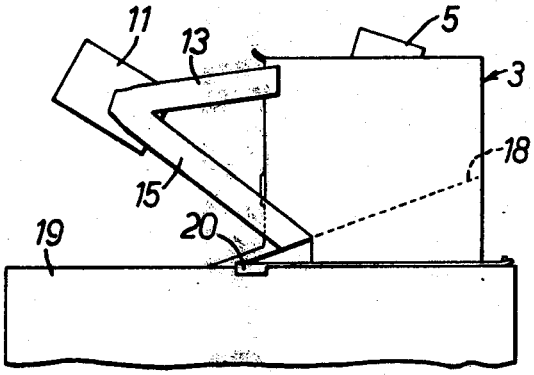
FIG. 3 is a side elevation of the same shot maker positioned over a container.

In FIG. 3 the support members 13 and 15 are visible. The shot maker 1 is placed over a five liter vessel 19 and is held in place by means of lugs (one of which, 20, is shown in FIG. 3) provided on the plate 2, which fit over the edge of the vessel 19.

Figure 4:
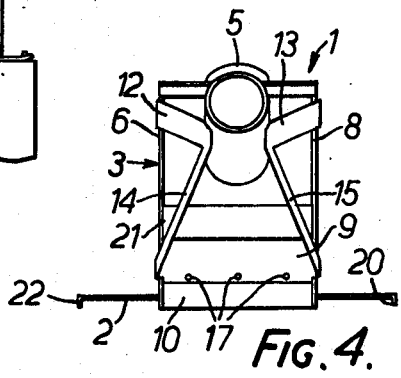
FIG. 4 is a front elevation of the same shot maker looking at the left side of the device as shown in FIG. 3.

In FIG. 4, all four support members 12,13,14 and 15 for the torch holder 11 are visible. Also clearly shown is the wall 9 with the holes 17. The wall 9 is provided with a copper lip 21 to protect the steel plate of wall 9 from the effects of the torch. Also shown is another of the lugs, in fact lug 22, which is opposite 20.

The shot maker can be operated as follows:

Lead ingots are introduced into the container 3 via the tube 5 and are melted down in the container 3 at a temperature of, say, 190° C. to 200° C. by a calor gas torch 23 located in the torch holder 11 to form molten metal 24 in the container. As indicated by arrows 25 in FIG. 2, part of the flame from the torch directly heats the ingots, and another part heats directly the lip 21, with part of the hot air stream being deflected down the chute 10. The molten metal 24 runs down the base plate 18 of the container 3, then through the holes 17, and drops onto the shot chute 10 in the form of droplets 26. The molten metal droplets 26 then run down the shot chute 10 and drop into the vessel 19.

This device can be used to produce, say, 25 kg of lead shot in one batch and can result in a 50% saving in costs by making and reloading one's own lead shot rather than purchasing it. Shot of varying size can be produced by regulating the temperature; the higher the temperature, the smaller the shot.

I claim:

1. An apparatus for making shot which comprises:

a container for holding metal used to make shot, said container having a bottom wall and a side wall, openings formed in said side wall through which molten metal can pass;

an inclined chute leading down and away from said container and below said openings;

a holder attached to said container adjacent said side wall and adapted to hold a heating means capable of melting metal to a flowing condition and cause heat to be directed toward said side wall, whereby to heat the metal in said container and optionally said side wall and said chute and melt said metal to a flowing condition, whereby molten metal passes through said openings and drops onto said chute.

2. An apparatus according to claim 1, wherein said holder is angled such that, in use, the heating means partially heats the metal in the container directly and partially heats said side wall of the container provided with openings, and wherein said chute is also heated by heat conducted from said side wall and/or heat deflected by said side wall.

3. An apparatus according to claim 1 or 2, wherein said holes in the side wall of the container have a diameter of approximately 0.04 cm and are located at a height of from 0.3 to 0.1 cm above said chute.

4. An apparatus according to claim 1, 2, or 3 wherein said chute is at an angle of approximately 20° C. to the horizontal and has a length in the range from 2.2 to 2.5 cm.

5. In combination, an apparatus according to claims 1, 2, 3, or 4, and further including a housing for holding water, said apparatus being positioned above said housing whereby in use, shot dropping on to said chute can fall into said water in said housing.

6. An apparatus according to claim 1 wherein said heating means is a torch.

* * * * *